United States Patent [19]

Censuales

[11] 4,121,448

[45] Oct. 24, 1978

[54] PROCESS AND A DEVICE FOR COLD WORKING METAL SHEET, WITH A DOUBLE ACTION IN A SINGLE OPERATIVE STAGE

[76] Inventor: Angelo Censuales, No. 19, Via A. Crescenzio, Palermo, Italy, 90142

[21] Appl. No.: 831,621

[22] Filed: Sep. 8, 1977

[30] Foreign Application Priority Data

Sep. 20, 1976 [IT] Italy ..... 51357 A/76

[51] Int. Cl.[2] ..... B21D 22/00; B21B 25/00

[52] U.S. Cl. ..... 72/348; 72/466

[58] Field of Search ..... 72/348, 465, 466

[56] References Cited

U.S. PATENT DOCUMENTS

| | | | |
|---|---|---|---|
| 2,754,785 | 7/1956 | Zatzo | 72/348 X |
| 2,763,228 | 9/1956 | Lawson | 72/348 X |
| 3,113,377 | 12/1963 | Oakes | 72/348 X |

*Primary Examiner*—Leon Gilden

*Attorney, Agent, or Firm*—Beveridge, DeGrandi, Kline & Lunsford

[57] ABSTRACT

A device for cold working a metal sheet, with double action in a single operative stage, suitable particularly for forming drawn articles in a single body with a shaped and folded bottom, comprising reciprocating drawing means including a forming punch rigid with a first part of a reciprocating press; a male member arranged for carrying out a conventional drawing operation in cooperation with a sheet-presser; said male member receiving in its inside an auxiliary punch mounted partially slidable within said male member, said auxiliary punch being arranged for cooperating with an elastic element; the arrangement being such that at the point of maximum engagement between said forming punch and said male member said auxiliary punch carries out a first shaping operation of the bottom of said drawn body with the contemporaneous storage of deformation power in said elastic element and said auxiliary punch carries out the deformation or folding of said bottom at the moment of the mutual moving away of said male member from said forming punch due to the release of the deformation power of said elastic element on said auxiliary punch.

5 Claims, 8 Drawing Figures

PROCESS AND A DEVICE FOR COLD WORKING METAL SHEET, WITH A DOUBLE ACTION IN A SINGLE OPERATIVE STAGE

The present invention relates to a device and a process for cold working metal sheet, with a double action in a single operative stage.

More particularly, the present invention relates to a device and to a process for obtaining in a single operative stage, drawn articles, such as for instance cans of tinned plate having a drawn wall in a single body with a shaped and folded bottom, as it will be better shown later on.

The present invention will be described with reference to one embodiment thereof at present preferred, disclosed by way of non limitative example, and with reference to the attached drawings, wherein.

Figure 1:
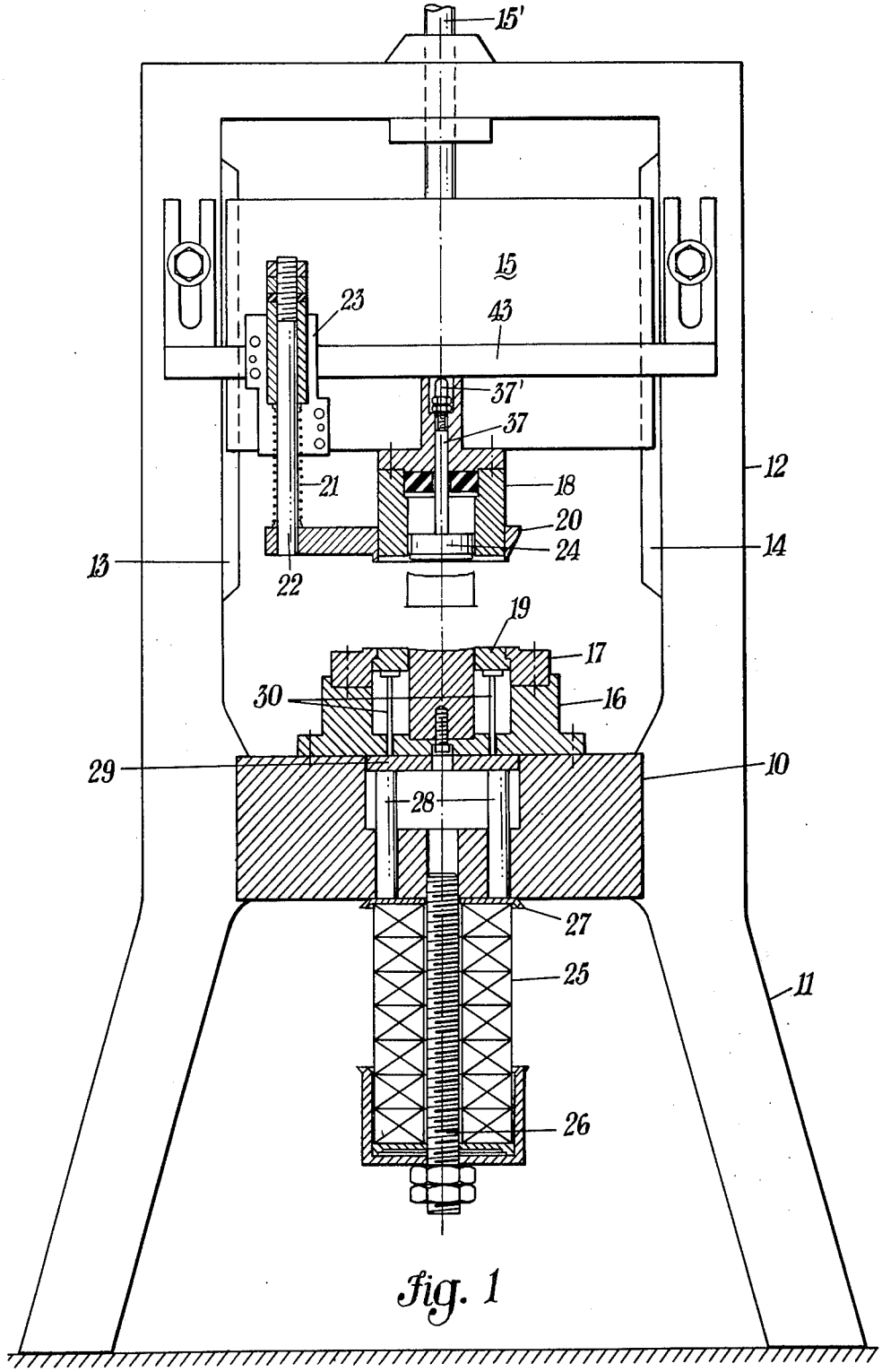
FIG. 1 is a diagrammatic general view, partially sectioned, of the sheet forming device according to this invention.

With reference to the drawing, and particularly to FIG. 1, the press according to this invention comprises a bed 10 supported by a base 11. From the bed 10 extends upwards the frame 12 on which are mounted the guides 13, 14 along which can slide a slider 15 driven by a shaft 15', driven in turn by a connecting rod and crank linkage not shown in the figure. This part of the machine, as described, is conventional and it can have other structural forms.

Turning now to the members for working the sheet, these members include a support 16 fixed to the bed 10 of the press, supporting a female cutting member 17 arranged for co-operating with the cutting edge of an annular male drawing member 18 associated to the slider 15.

The support 16 and the cutting member 17 define an annular recess wherein is contained the sheet presser 19 which can slide parallel to itself, as it will be described later on.

The cutting member 17 co-operates with the sheet presser 20 which surrounds the male member 18 and is elastically downward pushed by the spring 21 guided by the shaft 22 slidable within a sleeve 23 associated in a not shown way to the slider 15.

Inside the male member 18 is a bore which contains an auxiliary punch 24, the function and structure of which will be described later on.

The sheet presser 19 can move, parallel to itself, downwards with respect to its position as shown in FIG. 1, against the action of the spring pack 25 mounted on the shaft 26 fixed to the lower part of the bed 10.

The stress exerted against and by the spring unit 25 is transmitted to the sheet presser 19 by the disc 27, by the studs 28, by the disc 29 and by the two rods 30.

Figure 2:
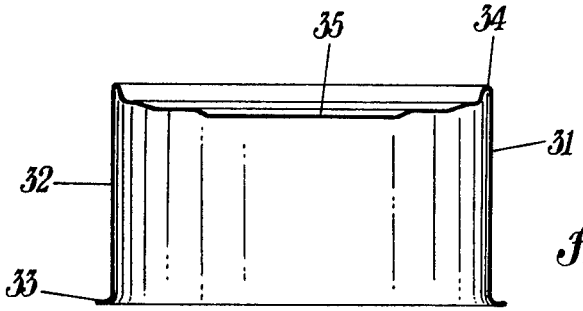
FIG. 2 shows a sectional view of a typical article made of drawn and shaped sheet obtained by the process and the device according to the present invention.

Let us refer, now, to FIG. 2 showing a typical article which can be obtained by the process and the device according to this invention.

It is a metal can body 31 made of tinned plate for conventional cans. The metal can comprises a substantially right wall 32, and edge 33 destined to the seaming of the cover (not shown), a folded edge 34 and a step-shaped bottom 35.

According to the present invention, the complex shaping of the can 31 is obtained in a single operation stage, starting from a flat metal sheet.

Let us consider now the FIGS. 3 to 6 showing the detailed development of a forming operation cycle of a can as shown by example in FIG. 2.

Figure 3:
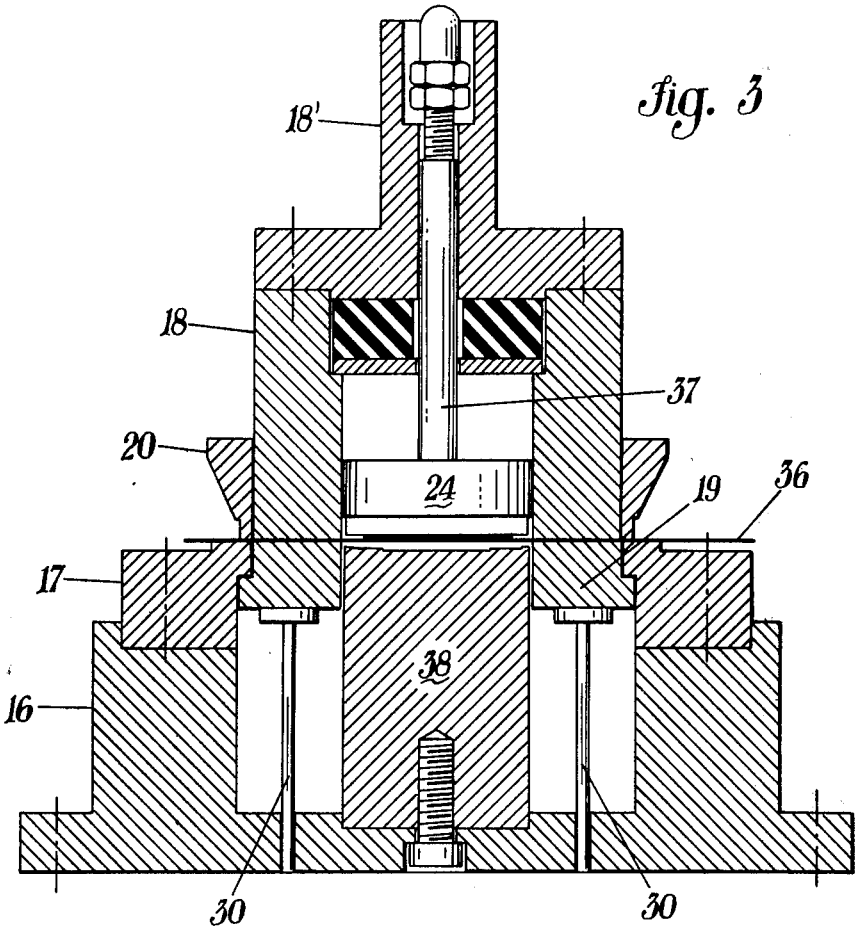
FIGS. 3, 4, 5 and 6 show the different operative stages of the tools of the machine of FIG. 1, in order to obtain the drawn article as shown by way of example in FIG. 2.

The FIG. 3 shows the initial position wherein a flat sheet 36 is locked in its position by the sheet presser 20 against the cutting member 17. The slider 15 of the press is assumed to have moved down through a certain stroke, downward moving the male cutting member 18 which by its spigot 18' is held in a suitable seat of the slider 15. The auxiliary punch 24, guided by the inner wall of the cylindrical element 18 and by the rod 37 freely bears on the overside of the sheet 36.

Figure 4:
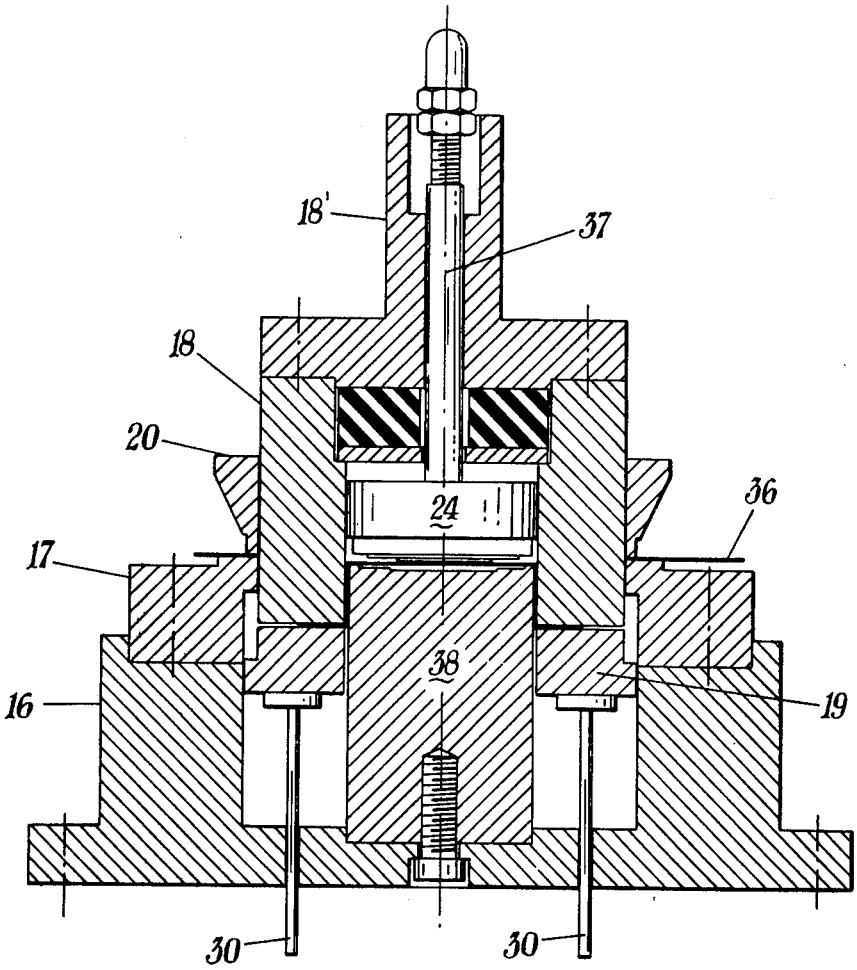

A further downwards movement of the element 18 causes the sheet 36 to be cut at the wanted measure. The element 18 continues its downward movement and starts drawing and stretching the cut sheet between the inner bore wall of the element 18 and the outer wall of the forming punch 38 the stationary lower end of which is fixed to the support 16 (FIG. 4). Simultaneously the auxiliary punch 24 moves upwards within the bore of the element 18 still resting on the overside of the sheet 36 which is being drawn and stretched. Simultaneously, the rods 30, impart the thrust received from the sheet presser 19 to the spring pack 25 as shown in FIG. 1.

Figure 5:
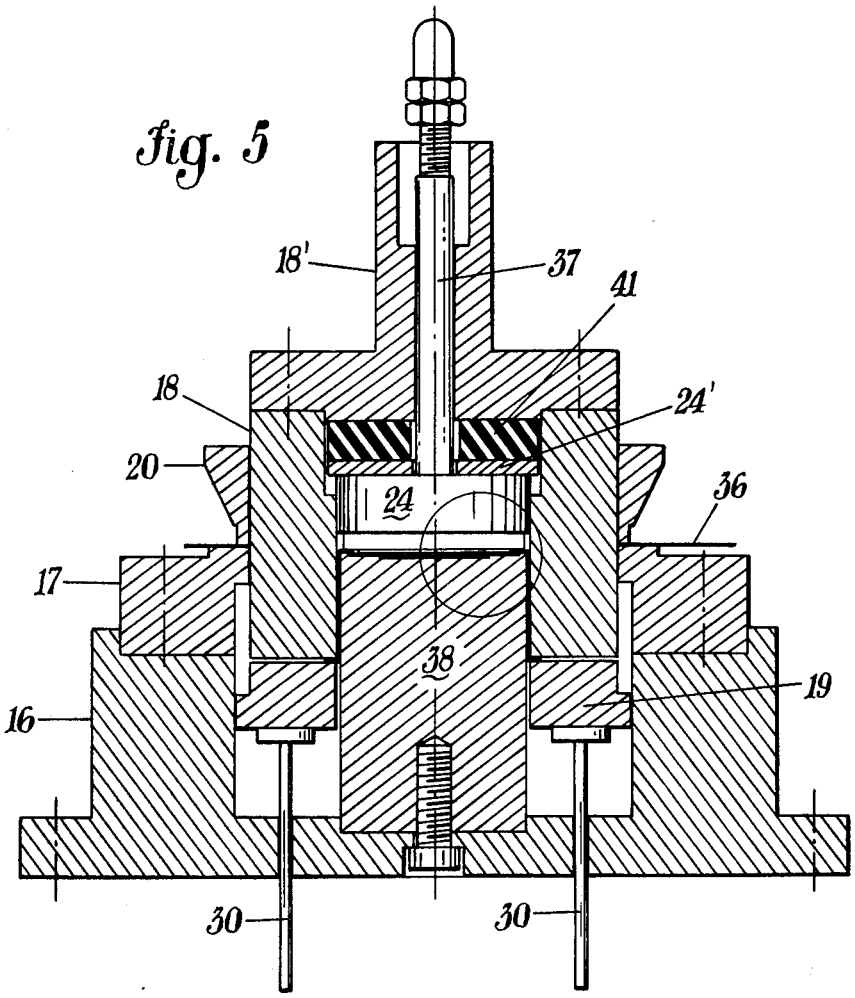

The drawing operation, as shown in FIG. 4 continues down to the bottom dead point in the conditions as shown in FIG. 5.

As shown in FIG. 5, the element 18 has moved through its entire downward stroke, receiving in its bore the element 38 and completing thus the formation of the wall of the can with its edge.

Figure 5A:
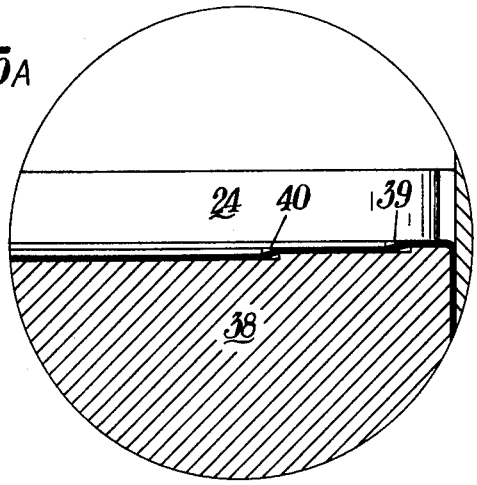

When the bottom dead point has been reached, the formation of the bottom will start. In fact, the auxiliary punch 24 bears against the head of the punch 38 embodying the shaping as better shown in the enlarged detail of FIG. 5*a* where the auxiliary punch 24 contacts the central portion but not the peripheral portion of the bottom of the formed article. The "steps" 39, 40 are formed, while the auxiliary punch 24 is pressed against the disc 24' which compresses an elastic element 41. This operation and the next one which will be described are possible as the part of sheet forming the bottom of the can has not been work-hardened by the drawing and stretching operation of the side wall.

Figure 6:
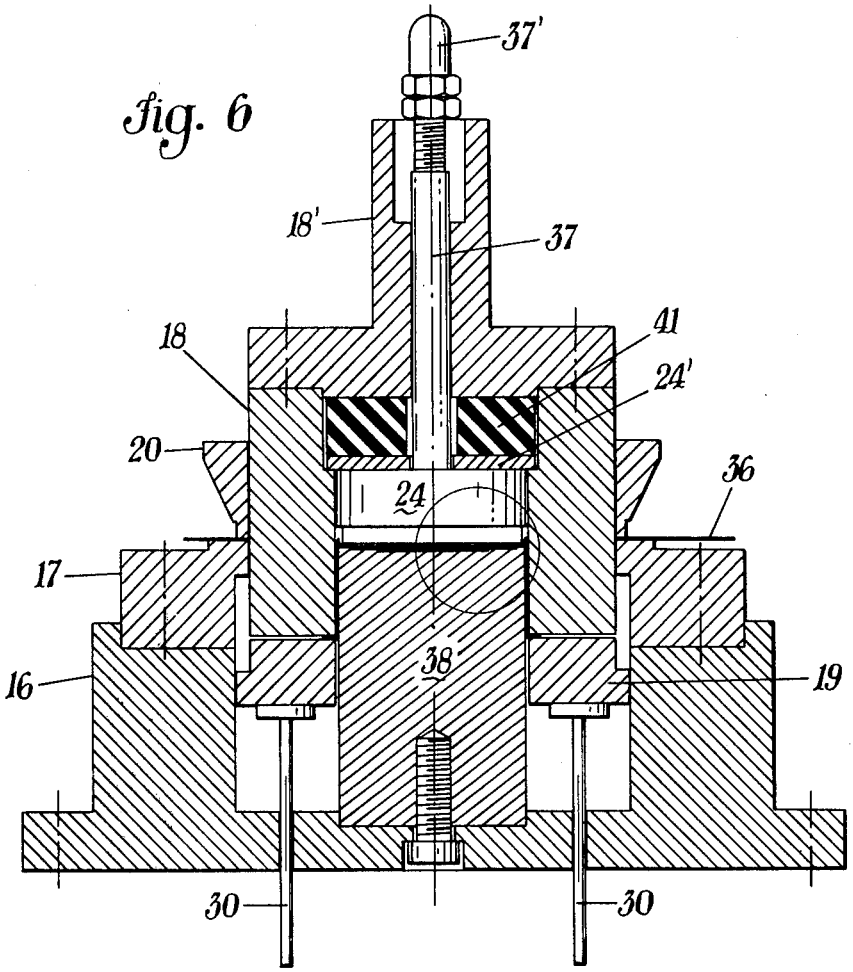
Figure 6A:
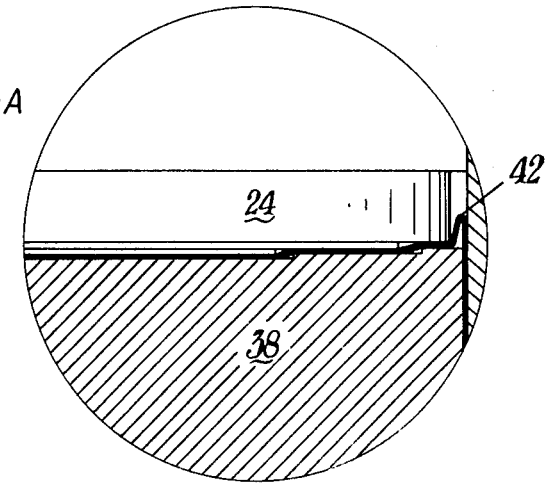

The FIG. 6 shows the final stage of forming or shaping the bottom. This final stage begins with the start of the upwards movement of the slider 15 of the press from its bottom dead point as shown in FIG. 5. When the element 18 starts moving upwards, the deformation power stored by the compression of the elastic element 41 will be delivered. Thus the auxiliary punch 24, biased by the compressed elastic element 41, continues to press against the head of the punch 38 and against the central portion of the article bottom. Due to the upwards movement of the element 18 and of the sheet presser 19 which holds the can stationary within male member 18, the wall of the metal can "moves upwards" with respect to the part of the bottom held between the auxiliary punch 24 and the head of the punch 38, causing the peripheral portion of the article bottom to form the fold 42 in the annular space around the member 24 as shown in the enlarged detail of FIG. 6*a*.

It will be noted that this is a progressive operation which occurs between the condition shown in FIG. 5 and that shown in FIG. 6.

When the slider 15 of the press moves upwards, also rises the element 18 carrying therewith the part of the can formed out of the engagement with the punch 38. When the upwards stroke continues, the sheet presser 19 will stop against the abutment formed by the internal part of the cutting member 17 releasing the edge 33 (FIG. 2) of the can which however is still inside the element 18 held by friction.

The expulsion of the formed can occurs due to the action of the auxiliary punch 24 which through the rod 37 and the cap nut stop 37' strikes the bar 43 mounted on the frame 12 of the press (FIG. 1).

It will be noted that in FIG. 1 the bar 43 has been shown, for sake of clearness in a position geometrically "impossible", for simplicity of showing the mode of its intervention.

It has been thus described the entire development of a working cycle starting from the initial conditions shown in FIG. 1 and coming again to the same initial conditions of "ready" for carrying out a new forming cycle.

Having thus described the present invention, what is claimed is:

1. A device for cold working a metal sheet, with double action in a single operative stage, suitable particularly for forming drawn articles in a single body with a shaped and folded bottom, comprising, reciprocating drawing means including a forming punch rigid with a first part of a reciprocating press; a male member arranged for carrying out a conventional drawing operation in co-operation with a sheet-presser; said male member having a bore for receiving said forming punch when forming an article, an auxiliary punch slidably mounted within said bore of the male member, an elastic element biasing said auxiliary punch relative to said male member in a direction toward said forming punch, said auxiliary punch being radially smaller than the forming punch and forming an annular space between the bore of the male member and the auxiliary punch whereby at the point of maximum engagement between said forming punch and said male member said auxiliary punch carries out a first shaping operation of the bottom of said drawn article with the contemporaneous storage of deformation power in said elastic element; and means for holding the drawn body staionary relative to the bore of the male member upon commencement of the separation of the male member from the forming punch, enabling said element to release its deformation power to move the auxiliary punch relatively to said male member against the bottom of the drawn body and form a folded rim in said annular space.

2. A device as claimed in claim 1, characterized in that said auxiliary punch is provided with a rod arranged so as to engage an abutment element and to effect the expulsion of the drawn article from said male member in correspondence with the return stroke of said drawing means.

3. A process for cold working metal sheet with double action in a single operative stage, for obtaining drawn articles with shaped and folded bottom, comprising the steps:

(a) cutting the sheet;

(b) drawing the side wall of the article between an internal punch and an external member having a bore, leaving undisturbed the bottom part;

(c) shaping said bottom of the article by pressing an auxiliary forming member against a central portion but not a peripheral portion of the bottom part;

(d) forming a folded rim in said peripheral portion of the bottom part by commencing the separation of said external member from said internal punch while holding said article stationary with respect to said external member and holding said auxiliary forming member against said central portion of the bottom part.

4. A process as claimed in claim 3 including the steps of compressing an elastically deformable element during step (c), and releasing the deformable element during step (d) to force said auxiliary forming member against the bottom part.

5. A device for manufacturing metal containers by drawing and forming metal sheets, comprising in combination a frame, reciprocating drawing and forming means slidable within said frame, stationary drawing and forming means arranged beneath said reciprocating means, said reciprocating means including a slider slidable on guide means on said frame, an annular drawing means rigidly connected with said slider, an annular upper sheet presser slidable on said annular drawing means, elastic means rigidly connected with said slider and pushing down said annular sheet presser, an auxiliary punch freely slidable within said annular drawing means and having a shaped surface for forming container bottoms, a rod fastened to the other surface of said auxiliary punch extending through a bore in said annular drawing means and having stop means at its end within an upper recess of said annular drawing means, a disc slidable on said rod in an inner recess of said annular drawing means, an elastic element arranged within said recess on said disc and apt to be compressed by said auxiliary punch to store an elastic power;

said stationary drawing means including a bed rigid with said frame, a support fastened to the upper surface of said bed and having a central recess, a stationary punch arranged within said recess to let free an annular space around said punch and having a shaped surface for forming container bottom, spring means arranged beneath said bed, an annular lower sheet presser arranged within said annular space around said stationary punch, means within said bed for connecting said spring means to said presser means whereby as soon as said annular drawing means has drawn the container on said stationary punch at the end of its downward stroke and begins its upward stroke, the auxiliary punch pressed by the elastic power stored in said elastic element pushes the container bottom onto said stationary punch for an instant during which said annular drawing means drags upwards for a short length the container wall for forming a folded rim on the container bottom.

* * * * *